United States Patent [19]

Meder

[11] 3,990,281

[45] Nov. 9, 1976

[54] DOUBLE CYLINDER PIN TUMBLER LOCK

[76] Inventor: Richard T. Meder, 2 Salem Lane, Port Washington, N.Y. 11050

[22] Filed: Aug. 16, 1974

[21] Appl. No.: 498,046

[52] U.S. Cl. ..... 70/364 A; 70/419; 70/DIG. 42

[51] Int. Cl.[2] ..... E05B 27/04

[58] Field of Search ..... 70/364 A, 416, 419, 70/DIG. 42

[56] References Cited

UNITED STATES PATENTS

| | | | |
|---|---|---|---|
| 2,024,497 | 12/1935 | Alberti | 70/419 X |
| 2,748,915 | 6/1956 | Byrnes | 70/364 A X |
| R26,272 | 9/1967 | Schreiber | 70/358 |

*Primary Examiner*—Robert L. Wolfe
*Attorney, Agent, or Firm*—Joel Halpern

[57] ABSTRACT

A pin tumbler lock in which a master cylinder is rotatably mounted within a housing and is drivable by a non-concentrically located drive cylinder also rotatably mounted within the housing. Bolt means are actuable by rotation of the master cylinder. A plurality of pin tumblers are positioned within respective pin bores and normally prevent rotation of both cylinders but are shiftable by key means into alternate positions whereby rotation of the master cylinder by the drive cylinder is permitted to thereby unlock the lock through actuation of the bolt means by the master cylinder.

8 Claims, 9 Drawing Figures

DOUBLE CYLINDER PIN TUMBLER LOCK

BACKGROUND OF THE INVENTION

Pin tumbler locks have been known heretofore. Such locks generally include a shell or housing in which a plurality of pin bores or chambers are provided. A cylinder or plug member is rotatable within the shell and is provided with a keyway ridge which extends axially of the cylinder within the keyhole thereof at approximately its mid-point. The pin bores are located within the shell such that pin members positioned therewithin are urged by spring means into seating engagement along the keyway ridge of the cylinder. The pin members are dimensioned such that they are out of longitudinal alignment at the shear point (the interface between the housing and cylinder) of the lock, and thus prevent rotation of the cylinder. An extension, frequently referred to as the "tail", is provided at the end of the plug. The tail is adapted, upon rotation of the plug, to turn a cam which actuates a bolt or bolt-actuating mechanism. Insertion of the correct key into the keyhole serves to lift the several pin members and seat them in the notches of the key. In this manner the pin members are aligned within the pin bores or chambers such that the upper pin segments, referred to as drivers, are positioned within the shell whereas the lower pin segments, referred to as pins, are positioned within the plug or cylinder. Thus, with all of the pins so aligned at the shear point of the cylinder it is rotatable to activate the bolt mechanism.

One of the principal drawbacks of the pin tumbler cylinder locks described above is its susceptibility to being picked. Briefly, picking such a lock involves the use of a tension wrench which is inserted into the lock and subjects the cylinder to torque. Simultaneously a pick is inserted into the lock to manipulate the pins sequentially within their chambers until the shear point for each is reached. At such time the cylinder will rotate slightly upon the freeing of the cylinder at that particular axial location. The pins in succeeding chambers are thus similarly manipulated until the shear point for the pin in each of such chambers has been found. When the shear point for the pin in the closest chamber to the exterior of the lock has been located, and the pin therein aligned with the shear point, the cylinder is completely rotatable and the bolt can be unlocked. The construction of such locks in permitting this direct interaction between the cylinder and bolting mechanism, and the detection of the alignment of the various pins at their shear points, during picking is an inherent weakness of such locks in respect of the degree of protection which they afford. The inherent weakness also stems from the fact that the lock element which is actuable directly by the key, and is accessible to the holder of the key, also operates the bolting mechanism.

SUMMARY OF THE INVENTION

In view of the foregoing it is one object of the invention to provide a pin tumbler cylinder lock having enhanced resistance to picking.

It is another object of this invention to provide a pin tumbler cylinder lock in which the bolting mechanism is not actuable directly by manipulation of a cylinder.

It is still another object of this invention to provide a pin tumbler cylinder lock in which the shear points of the lock are made more difficult for a lock picker to detect.

Other objects and advantages of the invention will become readily apparent from the following description of the invention.

In accordance with this invention there is provided a pin tumbler lock, comprising a housing, a first drive cylinder and a second master cylinder rotatably mounted within said housing in parallel spaced relation, gear means carried by said drive and master cylinders adapted to effect a driving of said master cylinder by said drive cylinder in a predetermined timed relationship, bolt means actuable by rotation of said master cylinder, a plurality of pin tumblers normally biased into the paths of rotation of said drive and master cylinders to prevent rotation of said cylinders, selected ones of said pin tumblers being shiftable by key means into alternate positions whereby rotation of said drive cylinder is permitted, the non-selected pin tumblers being shiftable by rotation of said drive cylinder into alternate positions whereby further rotation of said drive cylinder effectuates rotation of said master cylinder and actuation of said bolt means.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
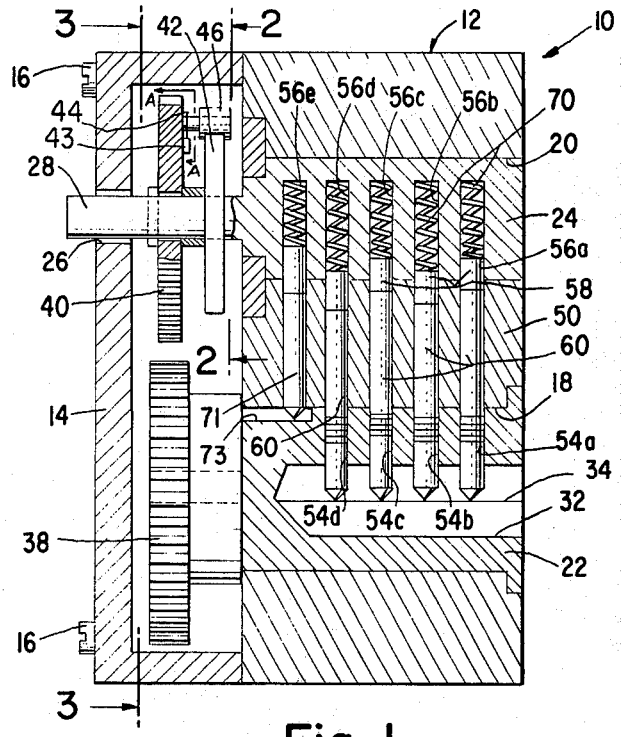
FIG. 1 is a side elevational view, in cross-section, of a pin tumbler cylinder lock embodying the invention with the device in a locked condition.

Referring to the drawings, there is shown a pin tumbler cylinder lock device 10 having a housing 12 to which there is secured a back plate 14 by any convenient fastening means such as screws 16. The housing is formed with boreholes 18, 20 that are dimensioned to rotatably support a pair of cylinders 22, 24 therein in spaced non-concentric relation. The cylinders may be rotatably mounted within the housing in the conventional manner such as by journalling their end segments in the housing. Preferably the cylinders are positioned one above the other within the housing in spaced parallel relationship, although it will be understood that this is not critical to the operation of the lock device. The back plate 14 is given an opening 26 through which axle shaft 28 of master cylinder 24 extends. The terminal portion of the axle shaft is adapted, in a conventional manner, upon rotation of the axle shaft, to act upon the bolt mechanism for the door or like sealing member (not shown) to effectuate locking or unlocking of the compartment to be protected.

Figure 3:
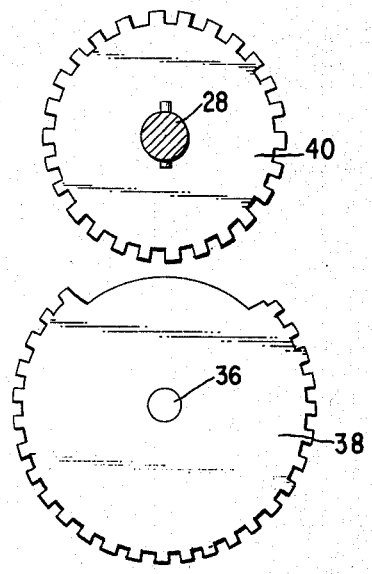
FIG. 3 is a sectional view of the drive cylinder gear and the master cylinder gear taken along line 3—3 of FIG. 1.

Cylinder 22 is a drive cylinder and is provided with an axially extending keyhole slot 32 within which there is formed a keyway ridge 34 that extends approximately the length of the keyhole for a purpose to be hereinafter described. A stub shaft 36 extends beyond the end of the drive cylinder and has a gear 38 fixedly secured thereto. Drive cylinder gear 38 is a sector gear, as can be seen more clearly from FIG. 3, with the non-toothed segment positioned normally along that portion of the gear circumference which is contiguous to a gear 40 carried by axle shaft 28 of the master cylinder. Master cylinder gear 40 and its relationship to drive cylinder gear 38 and to master cylinder cam 42 will be hereinafter described.

Master cylinder 24 is mounted rotatably within housing 12 in axially spaced relation to drive cylinder 22, as stated above, and the master cylinder is given an axle shaft 28 which carries rotatably thereon the master cylinder gear 40. Carried fixedly by axle shaft 28 and spaced from gear 40 by spacer member 41 is a cam 42. The cam is adapted to drive the master cylinder in the manner to be described.

Secured to master cylinder gear 40, preferably by means of a flat spring 44, which may be retained within a slot or groove in a block 43 secured to gear 40 is a follower member 46. The spring serves to bias follower 46 into close engagement with cam 42 so as to insure that the follower reposes in a recessed portion 48 of the cam. Rotation of the drive cylinder 22 and its associated gear 38, when the toothed segment of the drive cylinder gear is in meshed relationship with the master cylinder gear 40, results in rotation of the master cylinder gear. In view of the close engagement of follower 46 within the recess 48 of cam 42 the cam is rotated concomitantly with gear 40. Since cam 42 is secured fixedly to the axle shaft 28 of the master cylinder rotation of the cam will also serve to rotate master cylinder 24. It will thus be appreciated that in such circumstances gear 40, cam 42 and master cylinder 24 are caused to rotate as a unit by the drive cylinder gear 38.

Cam 42 is provided in order to achieve two principal objectives. First, if the drive cylinder is rotated by means of a key which will not lead to rotation of the master cylinder in accordance with the normal operation of the lock an attempt to force the lock would not result in damage to the gears since the follower 46 will simply ride out of recess 48 of the cam instead of resisting such force with a consequent damage to the gearing. Second, and equally important, at the beginning of a rotative cycle when the correct key is employed, cam 42 permits gears 38 and 40 to mesh before the control pins permit rotation of the master cylinder. At the end of the cycle the gears will continue in meshed engagement even after the control pins have been urged downwardly onto the surface of drive cylinder cam 73. This assures that the master cylinder will be rotated sufficiently to be "caught" by the control pin and locked against further rotation. Due to the provision of the cam the master cylinder can be rotated this extra amount required without fear of binding. Cam 42 thus obviates the need for precise gear synchronization.

The cylinders 22, 24 are so mounted in housing 12 that a section 50 of the housing is interposed therebetween. A first set of pin bores 52 *a–e* is formed in housing section 50 in longitudinally spaced relation. A second set of longitudinally spaced pin bores 54 *a–d* is formed in drive cylinder 22 and a third set of axially spaced pin bores 56 *a–e* is formed in master cylinder 24. As shown most clearly in FIG. 1, with drive and master cylinders 22, 24 in their initial non-rotated positions the corresponding pin bores of each set *a–e* of the same are aligned vertically. Within each of the aligned sets of pin bores there is positioned a master pin 58, an intermediate pin 60, a plurality of spacer elements 62 and a driver pin 64. Desirably the top of each driver pin, the bottom of the intermediate pins and both ends of each spacer element is given a slight chamfer. Such chamfering serves to assist in preventing detection of the proper alignment which may become more evident with the use of the lock since some chamfering of the correct pins and spacer elements occurs with usage of the lock.

It will be observed that the interface between master cylinder 24 and the housing section 50 provides a first shear point 66 and the interface between the drive cylinder 22 and the housing section 50 provides a second shear point 68. It will also be seen that an internal keyway ridge 34 is formed in the drive cylinder 22. The pins within each of the pin bores 52*a–e*, 54*a–d* and 56*a–e* are normally urged so as to effect the seating engagement of the lower end of each driver pin 64 on the keyway ridge by a spring 70 that is mounted in each of the pin bores 56 *a–e* above the master pin in each of such pin bores. The set of pin bores *e* preferably most removed from the entrance to the key slot are formed only in the master cylinder and housing and contain the control pins. Further, the spring 70 urges the control pins in pin bores 52*e* and 56*e* downwardly so as to seat the lowermost pin 71 on the surface of a cam element 73 carried for rotation with the drive cylinder. It will be noted from FIG. 1 that certain of the master pins 58 are dimensioned so as to be normally urged across the shear point 66 to project partially into pin bores 52. Such non-alignment of the lower ends of the master pins at shear point 66 prevents rotation of the master cylinder 24.

Figure 4:
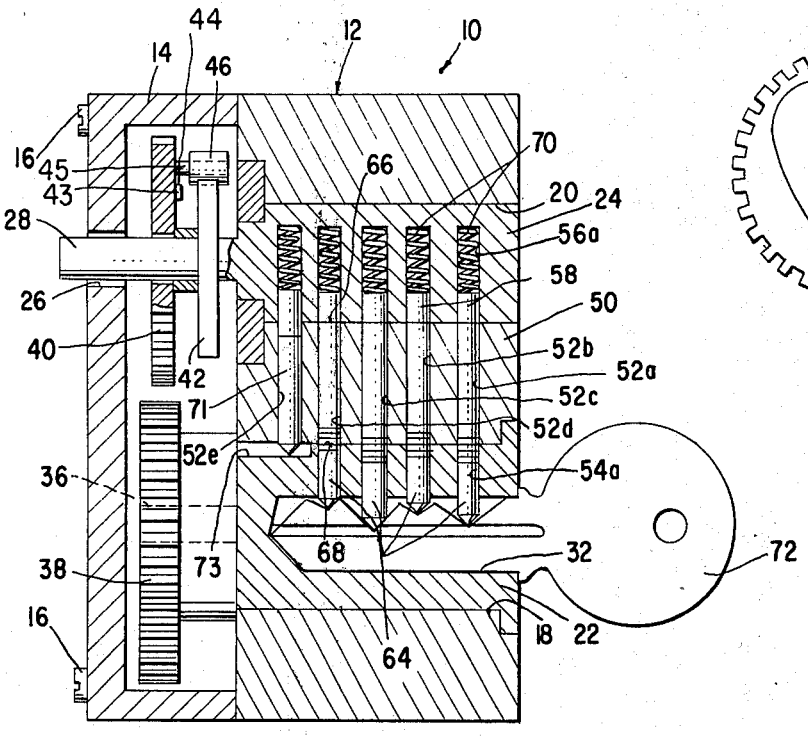
FIG. 4 is a view similar to FIG. 1 with the key in place within the keyhole and the pin members of the drive and master cylinders shifted to their shear points to permit rotation of the drive cylinder.
Figure 2:
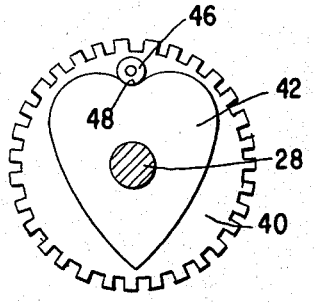
FIG. 2 is a sectional view taken along line 2—2 of FIG. 1 showing the master cylinder gear and cam with follower.
Figure 9:
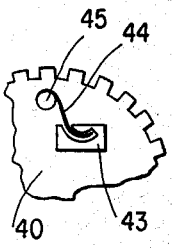
FIG. 9 is a fragmentary end view of the master cylinder gear and the flat spring secured thereto taken along line A—A of FIG. 1.

As depicted in FIGS. 1 and 4, selected intermediate pins in certain of the pin bores extend across the interface identified as shear point 68 and thereby prevent rotation of the drive cylinder 22. It will be seen that a plurality of such spacer elements are disposed between the intermediate and driver pins. The use of as many relatively short spacer elements as possible within the space limitations of the lock affords an increased number of combinations for the lock. Another expedient for rendering the lock more difficult to pick is to utilize a spacer sleeve concentric with the drive cylinder positioned to cooperate with the pins of one or more of the pin bores. As will be appreciated, the use of such spacer sleeves increases the number of shear points available within the lock and thus provides for increased protection. The spacer sleeve should have a thickness greater or less than the thickness of the spacer elements but not a multiple of such thickness.

Figure 5:
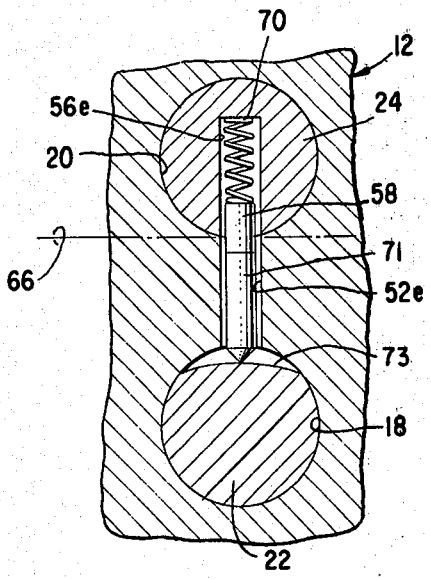
FIGS. 5–7 are diagrammatic views showing the relationship between the control pin elements, the master cylinder and the drive cylinder cam in various stages of rotation of the drive cylinder.
Figure 6:
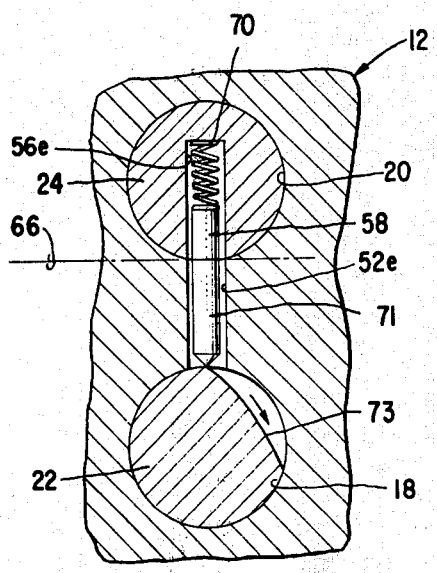
Figure 7:
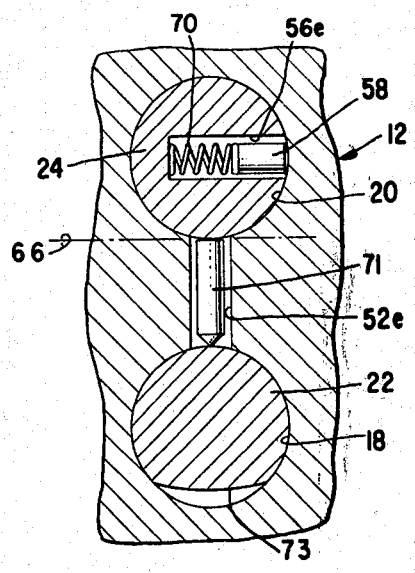

Referring to FIG. 4, it will be seen that the insertion of the correct key 72 into the keyhole slot 32 of the lock results in the raising of the driver pins from the keyway ridge 34 until each such pin settles into the corresponding notch of the key immediately beneath same. The key member is formed with its notches cut to a predetermined depth such that when inserted into the keyhole slot of the lock the driver pins will be raised specific amounts to align the spacer pins with either another of same or with an intermediate pin at shear point 68 and thereby permit rotation of drive cylinder 22. In the position illustrated by FIG. 4, the upper non-toothed segment of drive cylinder gear 38 is adjacent the master cylinder gear 40 in its normal position when the lock is in its "locked" condition. Rotation of the key in the lock and rotation of the drive cylinder does not result in immediate rotation of the master cylinder gear or of the master cylinder since there is a delay until the drive cylinder gear has been rotated to a position where its toothed segment engages with the teeth of the master cylinder gear. This time delay is desirable since it increases the difficulty with which the lock can be picked. Insertion of the correct key, however, performs the initial step of shifting selected pins within the pin bores so that they align themselves at the shear points as illustrated in FIG. 4. The drive cylinder 22 is fully rotatable in this position; however, the control pins in the last set of pin bores 52*e* and 56*3* are not yet properly aligned and will not permit rotation of the master cylinder. FIGS. 5–7 illustrate how rotation of the drive cylinder and of the drive cylinder cam 73 serves to elevate the control pins within 52*e* and 56*e* until they do align at shear point 66 as shown in FIG. 6. The master cylinder can now be rotated as shown in FIG. 7. Further rotation of the drive cylinder results in engagement of the master cylinder gear 40 by the toothed segment of drive cylinder gear 38. Continued rotation of the drive cylinder and its gear by turning of the key will cause rotation of the master cylinder gear, cam 42 and the master cylinder. At a predetermined point in the rotation of the master cylinder the bolt mechanism (not shown) will be activated to unlock the protected area. In locking the device, upon turning the key, pin bores 52*e* and 56*e* with the control pins therein will align themselves first due to the contour of the cam 73. The master cylinder will thus be locked against any additional significant rotation. Continued turning of the key and rotation of the drive cylinder results in the development of some degree of torsion on the master cylinder axle shaft. The drive cylinder gear 38 and the master cylinder gear 40 disengage permitting the cam follower 46 to reenter the recess of the cam. Further turning of the key serves to align the pin bores of the housing and drive cylinder so as to allow upward movement of those spacer pins below shear point 68 and thereby permit removal of the key.

Figure 8:
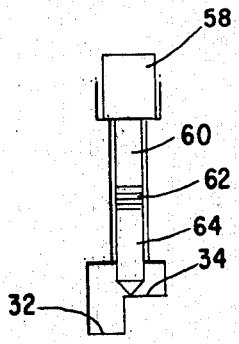
FIG. 8 shows the disposition of the pins within a single set of aligned pin bores according to a modification of the invention.

FIG. 8 is an illustration of a modified configuration for a set of pin bores. In particular, the pin bore located within the housing may be enlarged to contain a pin element having a diameter which is slightly larger than the diameter of the pin bore formed in the drive cylinder. This construction can be employed, if desired, for one or more of the pin bores and serves to prevent the removal of the upper pins in the event that a potential intruder drills through the keyway ridge and attempts to remove the pins to thus free the cylinders for rotation.

It will, of course, be understood that the materials from which the various elements of the lock are fabricated are not critical. It may, for example, be deemed expedient to utilize material which is incapable of being magnetized since there are certain lock-breaking techniques employing the magnetic principles.

Cam 42 is desirably dimensioned and given a weight distribution such that if the lock is being picked and the drive cylinder manipulated by means such as a tension wrench, once the wrench is released the cam will return to its normal position with the recess facing upwardly and the drive cylinder will also be returned to its position of rotation with the drive cylinder gear out of engagement with the master cylinder gear.

It will be appreciated that by the lock construction hereinbefore described there is no direct access to the master cylinder and the bolting mechanism. Furthermore, even if the lock is picked to the extent of enabling rotation of the drive cylinder it will still not be possible to unlock the lock. Rotation of the drive cylinder gear merely results in the free rotation of the master cylinder gear on axle shaft 28 and the riding of follower 46 over the surface of 42. No rotation of the master cylinder is possible until the master pins are brought into alignment with their respective shear points.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A pin tumbler lock comprising a housing, a first drive cylinder and a second master cylinder rotatably mounted within said housing in parallel spaced relation, a sector gear carried fixedly by said drive cylinder and a pinion gear carried rotatably by said master cylinder adapted to effect a driving of said master cylinder by said drive cylinder in time delay relationship, bolt means actuable by rotation of said master cylinder, a plurality of pin tumblers normally biased into the paths of rotation of said drive and master cylinders to prevent rotation of said cylinders, selected ones of said pin tumblers being shiftable by key means into alternate positions whereby rotation of said drive cylinder is permitted, the non-selected pin tumblers being shiftable by continued rotation of said drive cylinder into alternate positions whereby further rotation of said drive cylinder effectuates rotation of said master cylinder and actuation of said bolt means.

2. A pin tumbler lock according to claim 1, wherein said pin tumblers comprise a plurality of sets of pin elements positioned end-to-end within respective sets of pin bores the pin bores of each said set being formed in said drive and master cylinders and in that section of the housing interposed therebetween, spring means being positioned above the uppermost pin element of each set, and each set of said pin elements being shiftable by said spring means within its set of pin bores when the drive and master cylinders are in a rotative position such that said set of pin bores are in alignment whereby rotation of said cylinders is prevented by the positions adopted by said pin elements.

3. A pin tumbler lock according to claim 1, wherein said sector gear is fixedly carried by the axial shaft of said drive cylinder and said pinion gear is carried rotatably by the axial shaft of said master cylinder, said axial shaft of the master cylinder also being provided with a cam fixedly secured thereto, the non-toothed segment of said sector gear being adapted to interrupt the driving of said master cylinder by said drive cylinder when said drive cylinder and drive cylinder gear have been rotated a predetermined amount.

4. A pin tumbler lock according to claim 3, wherein said master cylinder cam is provided with a recess at substantially the mid-point of its upper surface, spring means being secured to said second gear and carrying a cam follower adjacent the end thereof urged into the base of said cam recess, whereby rotation of said drive cylinder drives said drive cylinder gear and said cam follower rides within said cam recess and causes said master cylinder cam and master cylinder to rotate.

5. A pin tumbler lock according to claim 4, wherein a second cam is operatively connected to said drive cylinder to be rotatable therewith, one of said sets of pin bores being juxtaposed above said drive cylinder cam, the lowermost pin element within the pin bores of said one set of pin bores being biased into engagement with the upper surface of said drive cylinder cam, whereby rotation of said master cylinder by said drive cylinder is prevented until said drive cylinder and the cam thereof have been rotated a predetermined amount.

6. A pin tumbler lock according to claim 2, wherein said plurality of pin elements of each set comprises (a) a master pin positioned at least partially within the pin bore of said master cylinder and biased across the interface between said master cylinder and said interposed section of the housing, (b) an intermediate pin positioned within the pin bore of said interposed section of the housing and across the interface between said section of housing and said drive cylinder, (c) a driver pin positioned within the pin bore of said drive cylinder and (d) a plurality of spacer elements positioned between said intermediate and driver pins, all of said pins and spacer elements being spring biased downwardly such that when the drive and master cylinders are in a predetermined rotative position and all of the pin bores of each set are in alignment certain of said pins and spacer elements extend across said interfaces and thus prevent rotation of said cylinders.

7. A pin tumbler lock according to claim 1, wherein the pin bore of each said set in the intermediate section of the housing is dimensioned to receive a pin element having at least a portion of the diameter thereof greater than that of the underlying pin bore whereby such pin element cannot be urged through said underlying pin bore.

8. A pin tumbler lock, comprising a housing, a pair of axially extending vertically spaced boreholes therein dimensioned to receive respectively a rotatable master cylinder and a rotatable drive cylinder, a plurality of first axially spaced pin bores in said housing extending between and substantially perpendicular to said boreholes and open at the opposed ends respectively to said master cylinder-receiving borehole and to said drive cylinder-receiving borehole, a master cylinder positioned rotatably within said master cylinder-receiving borehole having bolt-actuating means associated therewith and a drive cylinder positioned rotatably within said drive cylinder-receiving borehole, a plurality of second and third axially spaced pin bores being provided respectively in each of said master and drive cylinders alignable with corresponding ones of said first pin bores, said first, second and third pin bores, when aligned, forming respective sets of continuous pin bores each of which contains shiftably therein at least three pin members in end-to-end relation, spring means being positioned within each of said second pin bores for urging all of said pin members towards said drive cylinder so as to shift certain of the pin members within each set of pin bores across the shear points between the master cylinder and housing and the drive cylinder and housing to thereby prevent rotation of said cylinders, means being carried fixedly by said drive cylinder cooperable with means carried rotatably by said master cylinder for selectively and in out of time phase relationship rotating said master cylinder, and an axially extending aperture within said drive cylinder for slidably receiving a key member engageable with one end of selected pin members to shift said selected pin members within their respective pin bores to a position where said drive cylinder is rotatable to thereby drive said master cylinder and actuate said bolt-actuating means.

* * * * *